US006203198B1

(12) United States Patent
Stone

(10) Patent No.: US 6,203,198 B1
(45) Date of Patent: Mar. 20, 2001

(54) COMPOSITE CONTAINER FOR LIQUIDS

(75) Inventor: Michael George Stone, Howden (GB)

(73) Assignee: B.A.G. Corp., Dallas, TX (US)

( * ) Notice: Subject to any disclaimer, the term of this patent is extended or adjusted under 35 U.S.C. 154(b) by 0 days.

(21) Appl. No.: 09/390,403

(22) Filed: Sep. 3, 1999

(51) Int. Cl.[7] ..... B65D 30/16

(52) U.S. Cl. ..... 383/119; 383/104; 383/120; 220/9.2

(58) Field of Search ..... 383/119, 104, 383/120, 121.1; 220/9.1, 9.2, 9.3, 9.4

(56) References Cited

U.S. PATENT DOCUMENTS

| | | | | |
|---|---|---|---|---|
| 3,105,617 | * | 10/1963 | Felldin | 383/67 X |
| 4,901,885 | * | 2/1990 | Boots | 383/119 |
| 4,903,859 | | 2/1990 | Derby et al. . | |
| 5,025,925 | * | 6/1991 | Wiklund | 383/119 X |
| 5,071,025 | * | 12/1991 | Boots | 383/119 X |
| 5,076,710 | | 12/1991 | Derby . | |
| 5,158,369 | * | 10/1992 | Derby | 383/119 X |
| 5,209,364 | | 5/1993 | LaPoint, Jr. . | |
| 5,289,937 | * | 3/1994 | Boots | 383/119 X |
| 5,323,922 | | 6/1994 | Lapoint, Jr. et al. . | |
| 5,423,611 | * | 6/1995 | Sherrard | 383/119 X |
| 6,015,057 | * | 1/2000 | Stone et al. | 220/9.2 |

FOREIGN PATENT DOCUMENTS

| | | | | |
|---|---|---|---|---|
| 2 634 469 | * | 1/1990 | (FR) | 383/119 |
| 2 639 037 | * | 5/1990 | (FR) | 220/9.1 |
| 093006027 | * | 4/1993 | (WO) | 220/9.1 |

* cited by examiner

*Primary Examiner*—Jes F. Pascua
(74) *Attorney, Agent, or Firm*—Michael A. O'Neil

(57) ABSTRACT

A bulk bag for receiving, storing, transporting, and discharging liquids comprising four double layer side walls connected end to end to define four corners, four sleeves located at the four corners of the side walls, stiffener panels received between the double layers of the side walls, and stiffener rods received in the sleeves. The bulk bag may be provided with double layer baffles extending across the interior corners of the bulk bag and stiffeners received between the double layers of the baffles. The bulk bag may be provided with double layer dividers which extend across the interior of the bulk bag from the midpoints of the side walls and having stiffener panels therein.

6 Claims, 9 Drawing Sheets

COMPOSITE CONTAINER FOR LIQUIDS

TECHNICAL FIELD

This invention relates generally to flexible intermediate bulk containers also known as bulk bags, and more particularly to a composite container for receiving, storing, transporting, and discharging liquids which is adapted for stacking.

BACKGROUND AND SUMMARY OF THE INVENTION

Historically, flexible intermediate bulk containers (bulk bags) have been used for receiving, storing, transporting and discharging flowable materials of all types. Bulk bags are typically constructed in square, vertically rectangular, or circular shapes with lift straps attached to each of the uppermost corners of the square, rectangle or circle.

By way of example, flexible intermediate bulk containers are used for handling flowable materials in granular or powder form such as chemicals, minerals, fertilizers, foodstuffs, grains and agricultural products, etc. The advantages of such receptacles include relatively low weight, reduced cost, versatility and, in the case of reusable receptacles, low return freight costs.

U.S. Pat. No. 4,903,859 discloses a bulk bag adapted for use with liquids. The bulk bag of the '859 patent comprises four double layer side walls. Stiffeners formed from cardboard are inserted between the layers of the side walls thereby imparting sufficient rigidity to the container to permit its use with liquids. Although the bag of the '859 patent has been generally well received, its utilization is somewhat limited by the fact that it cannot be stacked to facilitate the transportation and storage of the bags and the contents thereof.

The present invention comprises an improved bulk bag design which overcomes the foregoing and other problems long since associated with the prior art. In accordance with the broader aspects of the invention, a bulk bag comprises four double layered side walls. The side walls receive stiffener panels which are formed from wood. Sleeves provided at each corner of the bulk bag receive stiffener rods also formed from wood. The bulk bag is provided with a double layered top which also receives a stiffener panel formed from wood.

When the bulk bag of the present invention is used to receive, store, transport and discharge liquids, it is typically provided with a liner comprising film formed from a plastic material such as polyethylene. In such instances, the bulk bag may be provided with baffles extending diagonally across each interior corner of the bulk bag to prevent the liner from pinching into the corners. When used, the baffles are preferably provided with stiffener panels formed from wood.

In accordance with another aspect of the invention, double layer dividers extend across the interior of the container from the midpoints of the side walls, thereby dividing the interior of the container into four quadrants. When employed, the divider panels are preferably provided with stiffener panels formed from wood.

The use of the present invention is highly advantageous in receiving, storing, transporting, and discharging liquids. For example, the present invention is readily adapted to receiving, storing, transporting and discharging orange juice, tomato paste, and other foodstuffs. Containers constructed in accordance with the invention are adapted for stacking. For example, certain embodiments of the invention can be stacked one on top of the other to a total height of six containers. The stackability of the container of the present invention is highly advantageous in facilitating transportation and storage of the containers and the materials contained therein.

BRIEF DESCRIPTION OF THE DRAWINGS

A more complete understanding of the invention may be had by reference to the following Detailed Description when taken in conjunction with the accompanying Drawings wherein:

FIG. 15 is an exploded perspective view of the fourth embodiment of the invention.

DETAILED DESCRIPTION

Figure 1:
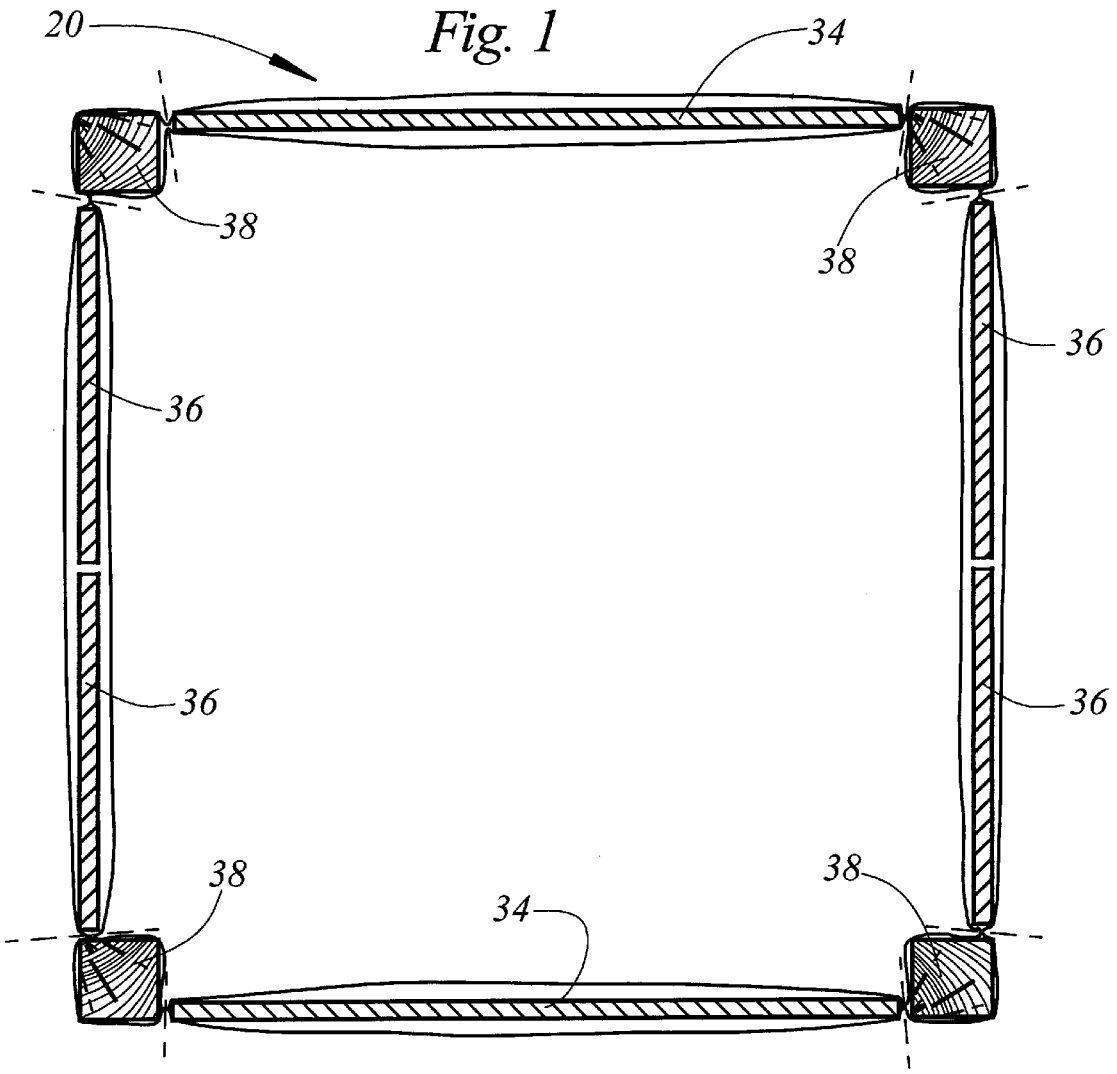
FIG. 1 is a diagrammatic illustration of a first embodiment of the invention.
Figure 2:
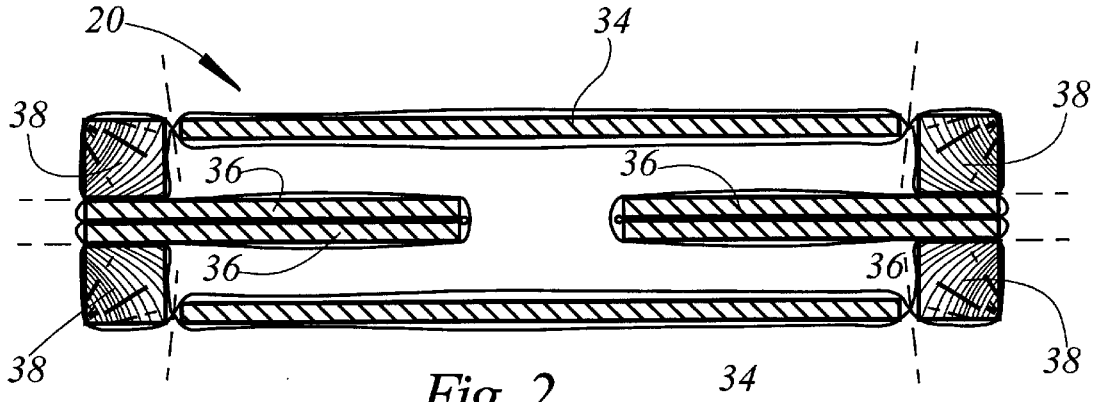
FIG. 2 is a diagrammatic illustration of the foldability of the first embodiment of the invention.
Figure 3:
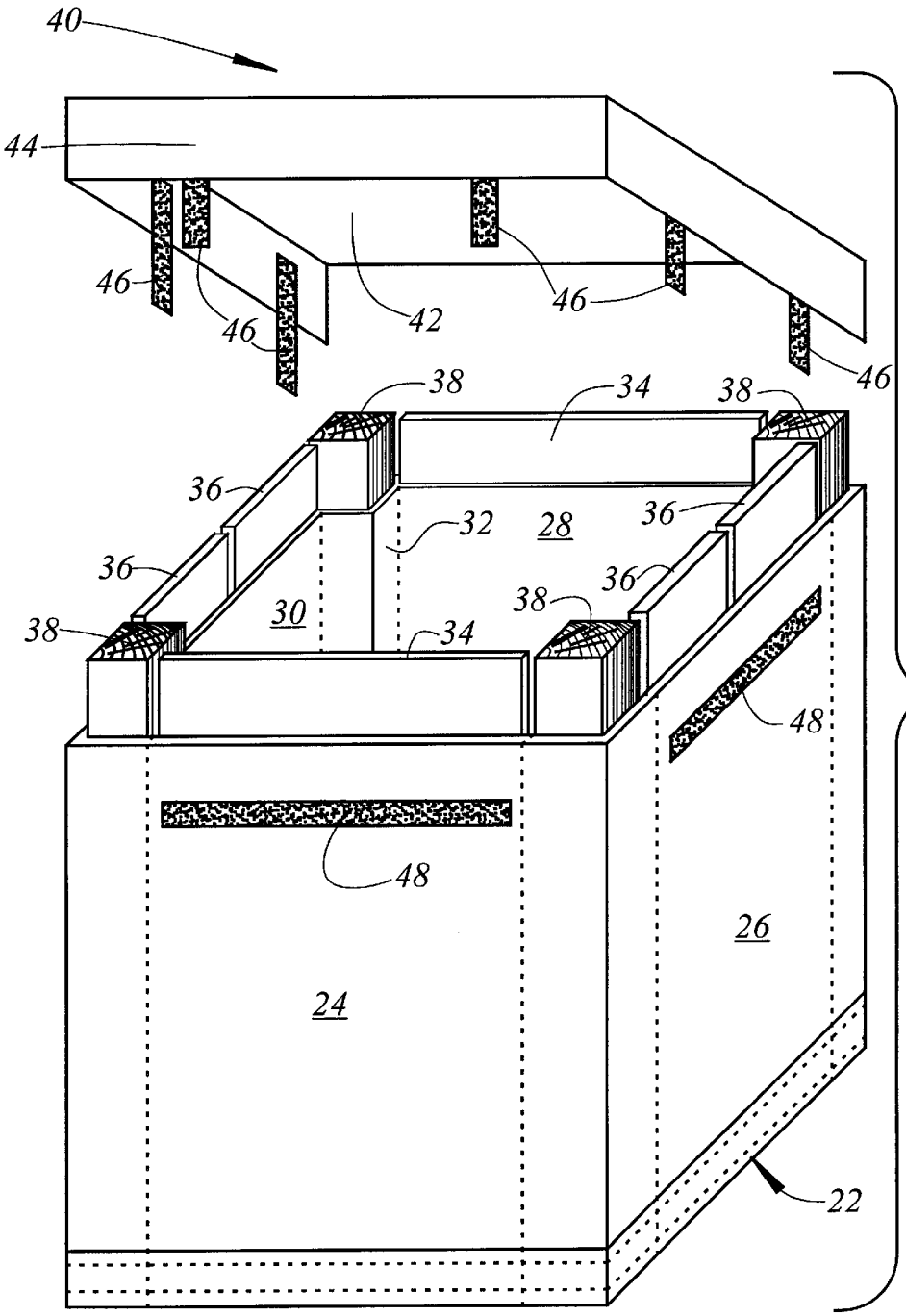
FIG. 3 is an exploded perspective view of the first embodiment of the invention.

Referring now to the Drawings, and particularly to FIGS. 1, 2 and 3 thereof, there is shown a bulk bag 20 comprising a first embodiment of the invention. The bulk bag 20 comprises a bottom wall 22 and four double layer side walls 24, 26, 28, and 30. The bottom wall 22 and the double layer side walls 24, 26, 28, and 30 are preferably fabricated from woven polypropylene fabric and are joined together by sewing in the conventional manner. Other materials and fabrication techniques can be used in constructing the bulk bag 20 depending upon the requirements of particular applications of the invention.

The double layer side walls 24 and 28 each receive a one piece stiffener panel 34. The double layer side walls 26 and 30 each receive a pair of stiffener panels 36. The use of the pairs of stiffener panels 36 in the side walls 26 and 30 facilitates the folding of the bulk bag 20 for storage and transportation prior to its ultimate utilization in the manner illustrated in FIG. 2.

The sleeves 32 each receive a corner stiffener rod 38. The stiffener rods 38 are preferably formed from wood and are preferably rectangular or square in configuration. The stiffener panels 34 and 36 which are received in the double layer side walls of the bulk bag 20 are preferably formed from oil impregnated five-ply plywood. Other conventional materials may be utilized in the practice of the invention, if desired.

Figure 4:
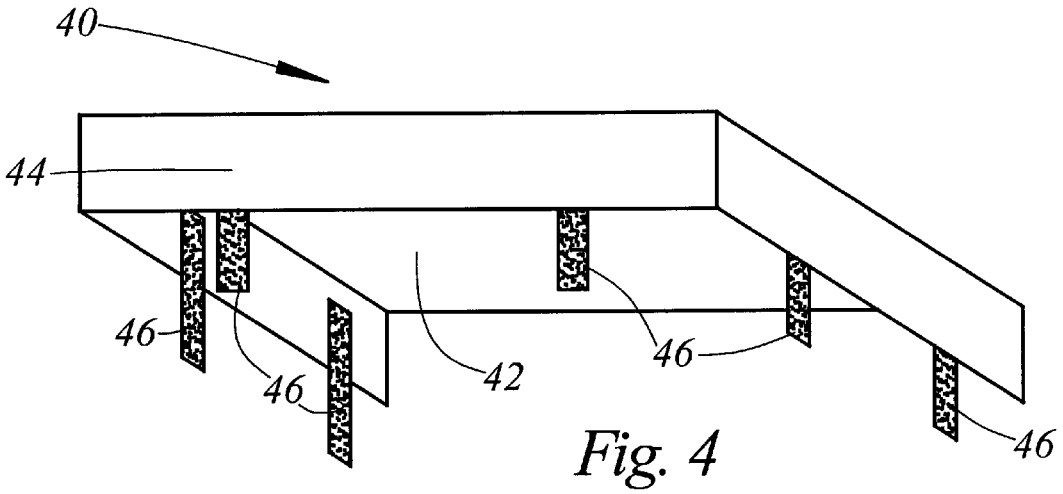
FIG. 4 is a perspective view of a container top useful in the practice of the invention.
Figure 5:
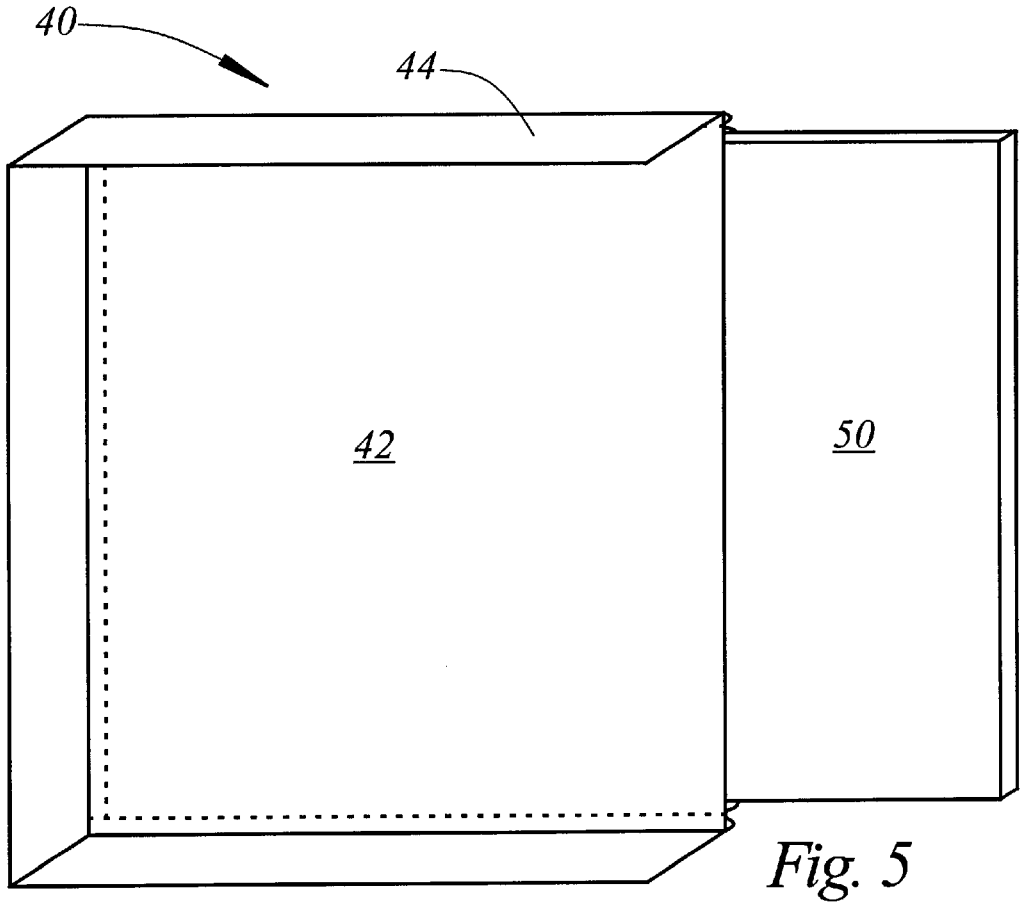
FIG. 5 is an illustration of the construction of the top of FIG. 4.

Referring to FIGS. 3, 4, and 5, the bulk bag 20 is provided with a top 40. The top 40 includes a double layer top wall 42 and a surrounding skirt 44. The top 40 is provided with a plurality of conventional fasteners 46 which cooperate with fastener receiving members 48 secured to the side walls of the container 20 to secure the top 40 in place. As is best shown in FIG. 5, the double layer top wall 42 receives a stiffener panel 50 which may be formed from oil impregnated five-ply plywood or other conventional materials in accordance with the requirements and particular applications of the invention.

Figure 6:
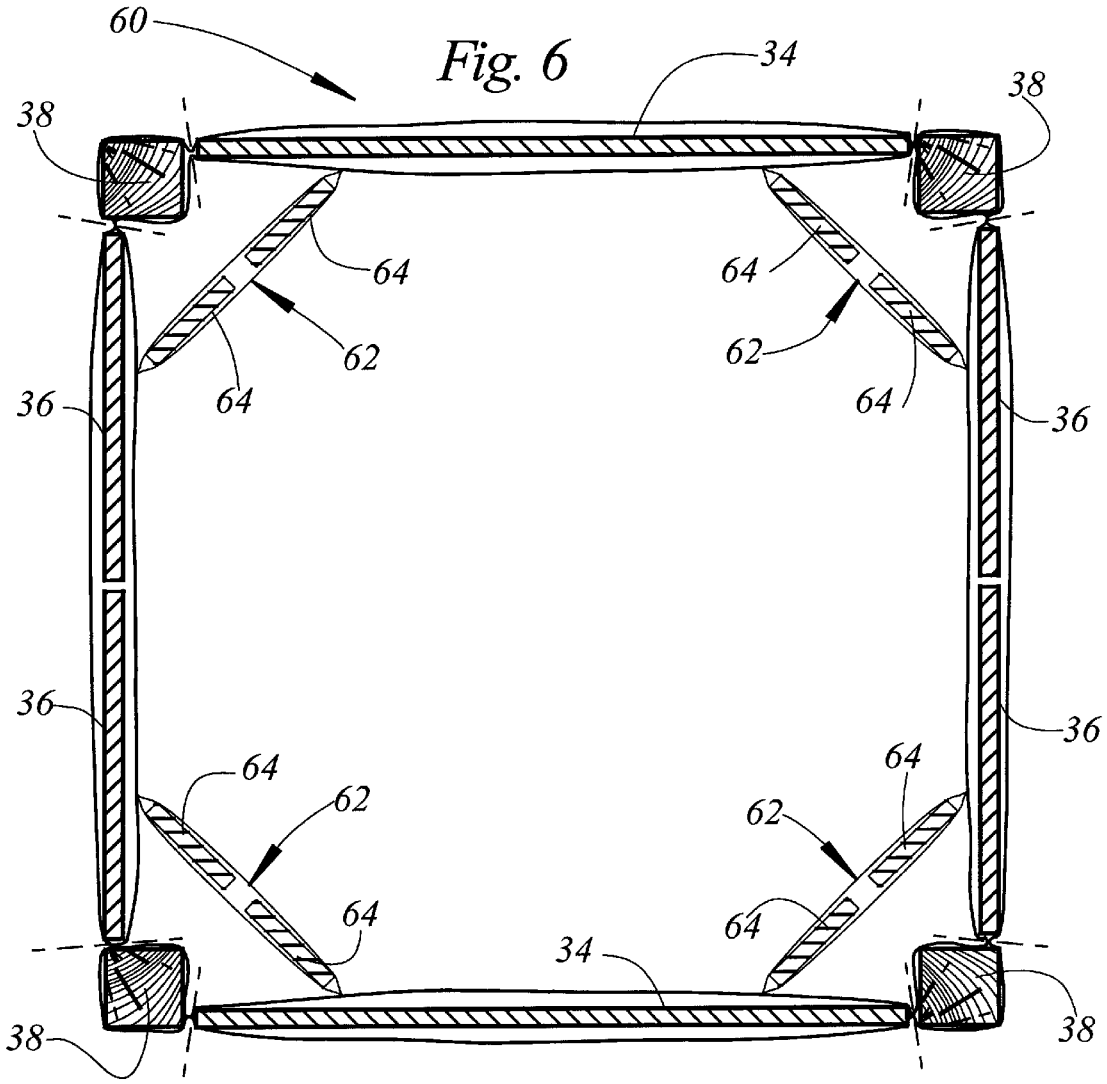
FIG. 6 is a diagrammatic illustration of a second embodiment of the invention.
Figure 7:
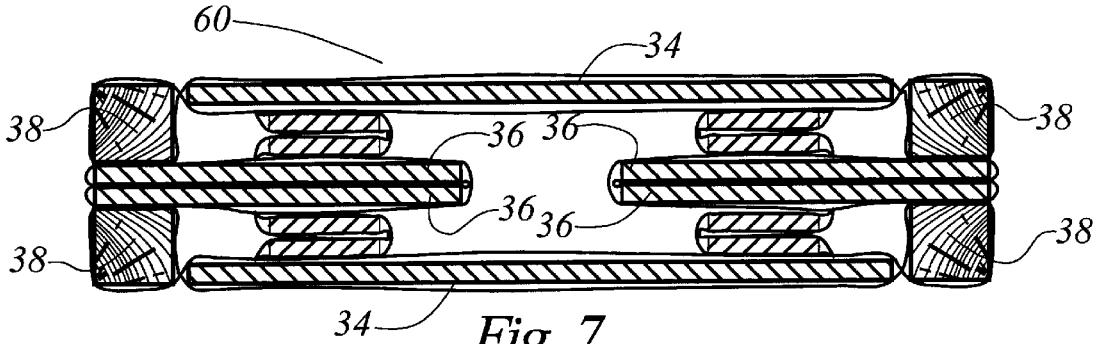
FIG. 7 is a diagrammatic illustration of the foldability of the second embodiment of the invention.
Figure 8:
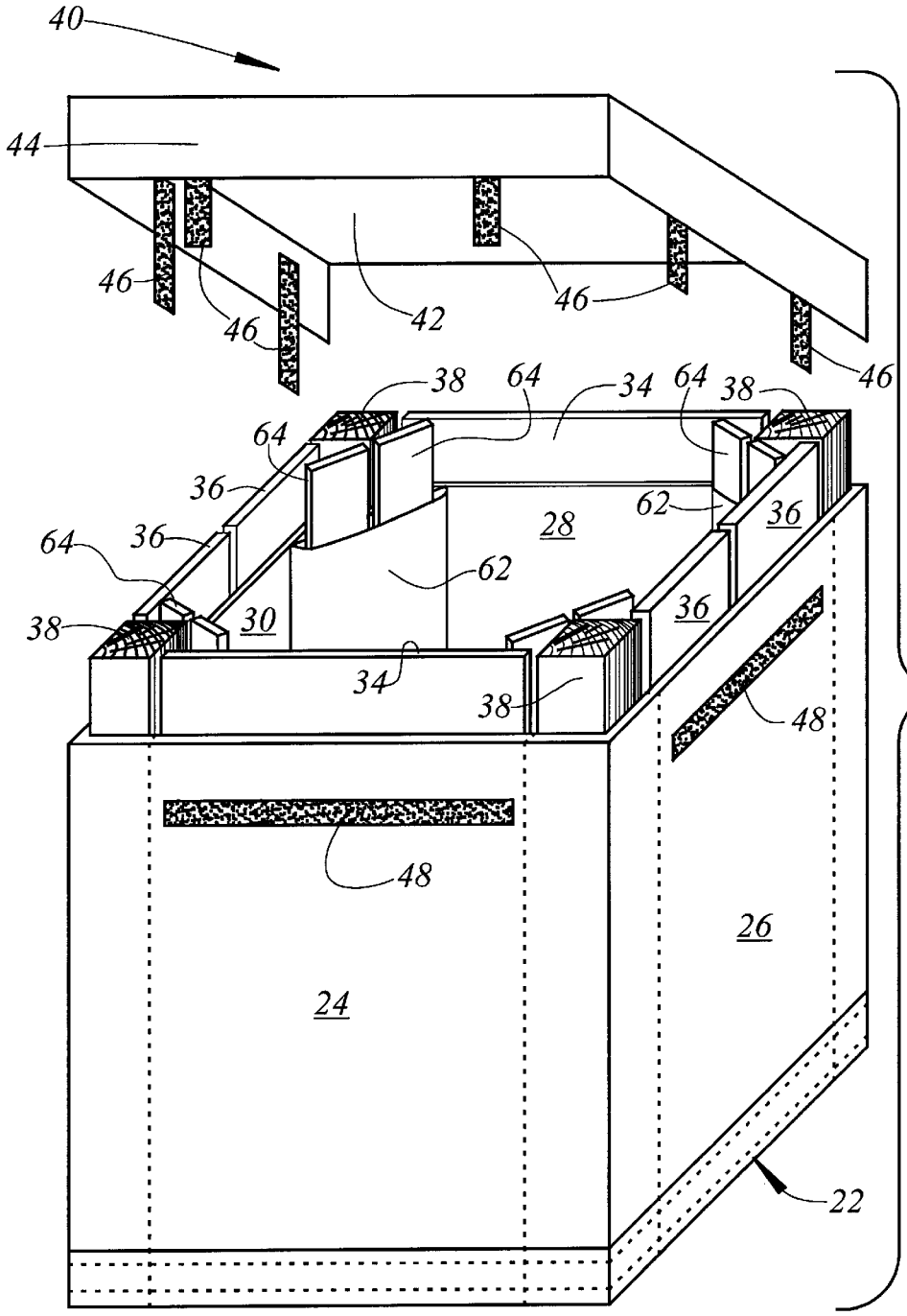
FIG. 8 is an exploded perspective view of the second embodiment of the invention.

A bulk bag 60 comprising a second embodiment of the invention as illustrated in FIGS. 6, 7, and 8. The bulk bag 60 is identical to the bulk bag 20 illustrated in FIGS. 1 through 5, inclusive, and described hereinabove in conjunction therewith except that the bulk bag 60 is provided with double layer baffles 62 extending diagonally across the interior corners of the bulk bag. The double layer baffles 62 are fabricated from woven polypropylene fabric and are connected to the double layer side walls of the bulk bag 60 by sewing in the conventional manner. Each double layer baffle 62 is provided with a pair of stiffener panels 64 which are preferably formed from oil impregnated five-ply plywood, it being understood that other conventional materials may be utilized in the fabrication of the bulk bag 60 and in the fabrication of the stiffener panels thereof in accordance with the requirements of particular applications of the invention.

The use of two stiffener panels 64 in each baffle 62 allows the baffles 62 to fold inwardly. The use of two stiffener panels 36 in the side walls 26 and 30 of the bulk bag 60 allows the side walls 26 and 30 to be folded inwardly. In this manner the bulk bag 60 is adapted for folding into the configuration illustrated in FIG. 7, thereby facilitating the transportation and storage of the bulk bag prior to its ultimate utilization.

Figure 9:
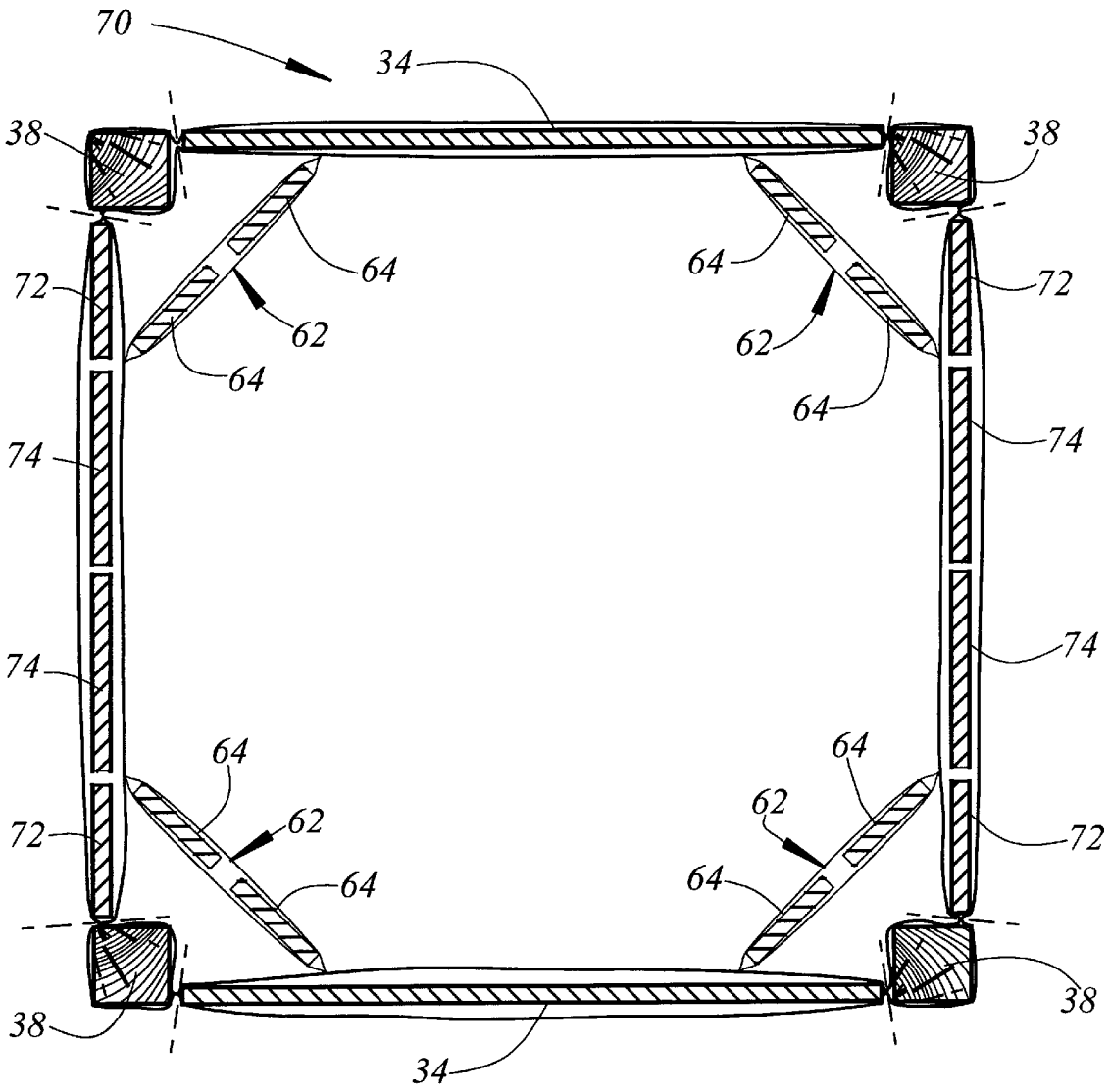
FIG. 9 is a diagrammatic illustration of a first variation of the second embodiment of the invention.

Referring to FIG. 9, there is shown a bulk bag 70 comprising a variation of the second embodiment of the invention. The bulk bag 70 differs from the bulk bag 60 in that the opposed double layer side walls 26 and 30 thereof are each provided with two stiffeners 72 located adjacent the ends of the side walls, and two stiffeners 74 located in the mid-portion of each side wall. The stiffeners 74 may be completely separate or hingedly interconnected depending on the requirements of the particular applications of the invention. The stiffeners 72 and 74 are preferably formed from oil impregnated by five-ply plywood, however, other conventional materials may be utilized in the fabrication of the stiffeners 72 and 74 depending on the requirements of particular applications of the invention.

Figure 10:
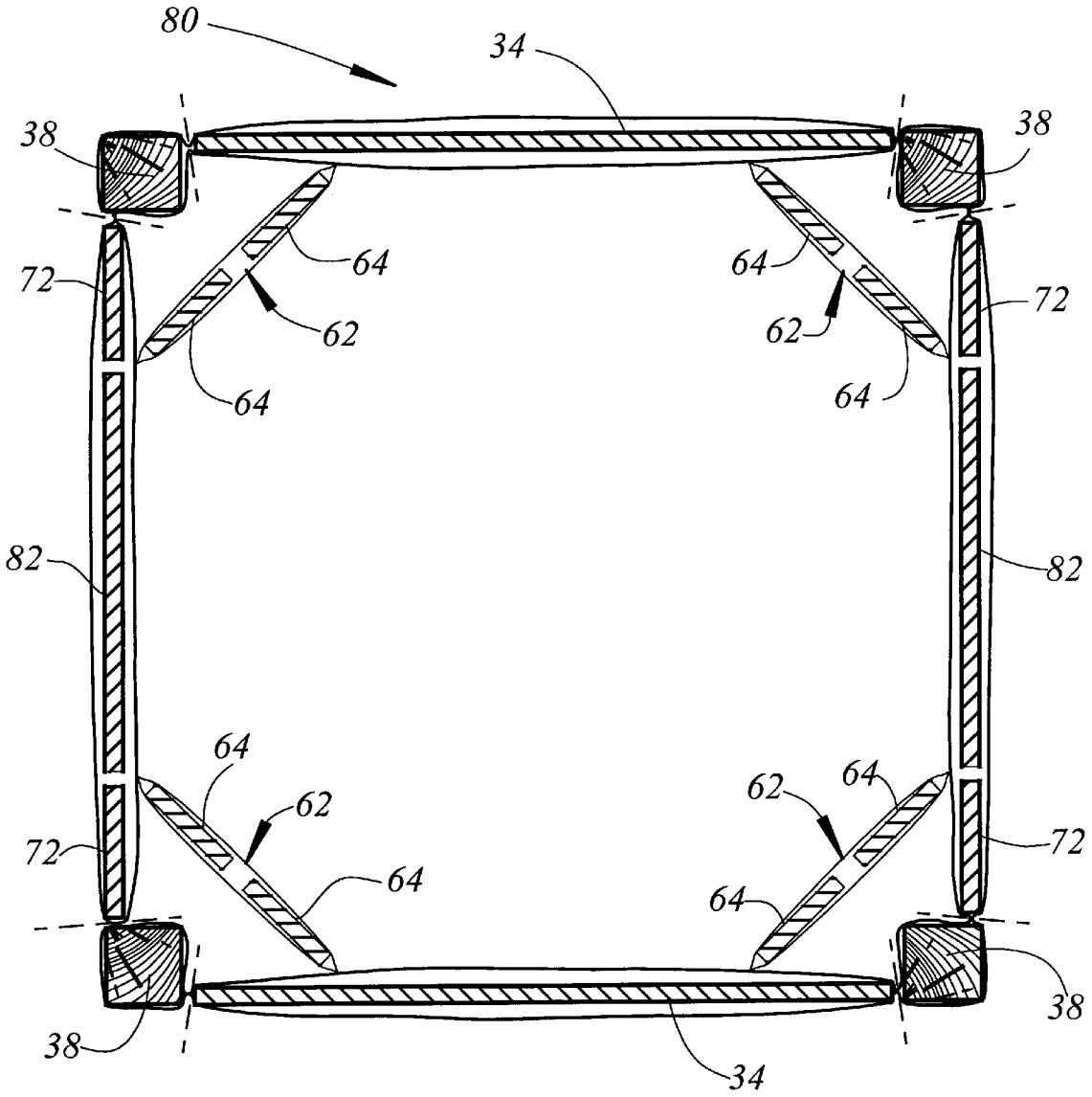
FIG. 10 is a diagrammatic illustration of a second variation of the second embodiment of the invention.

A bulk bag 80 comprising a second variation of the second embodiment of the invention is illustrated in FIG. 10. The bulk bag 80 differs from the bulk bag 70 illustrated in FIG. 9 and described hereinabove in conjunction therewith in that the bulk bag 80 employs a single stiffener 82 in the mid region of each of the double layer side walls 26 and 30. When the stiffeners 82 are utilized in lieu of the stiffeners 74, the side walls 26 and 30 of the bulk bag 80 are rendered non-foldable. This is advantageous in those applications of the invention in which the contents of the bulk bag are discharged by tipping the bulk bag so that the contents thereof flow outwardly from the open top.

It will be understood that the stiffeners 82 of the bulk bag 80 are interchangeable with the stiffeners 74 of the bulk bag 70. This is advantageous in that the same basic bulk bag construction can be utilized in the construction of two entirely different bulk bag types. In this manner inventory requirements are reduced and the adaptability of the bulk bag to particular applications of the invention is facilitated.

Figure 11:
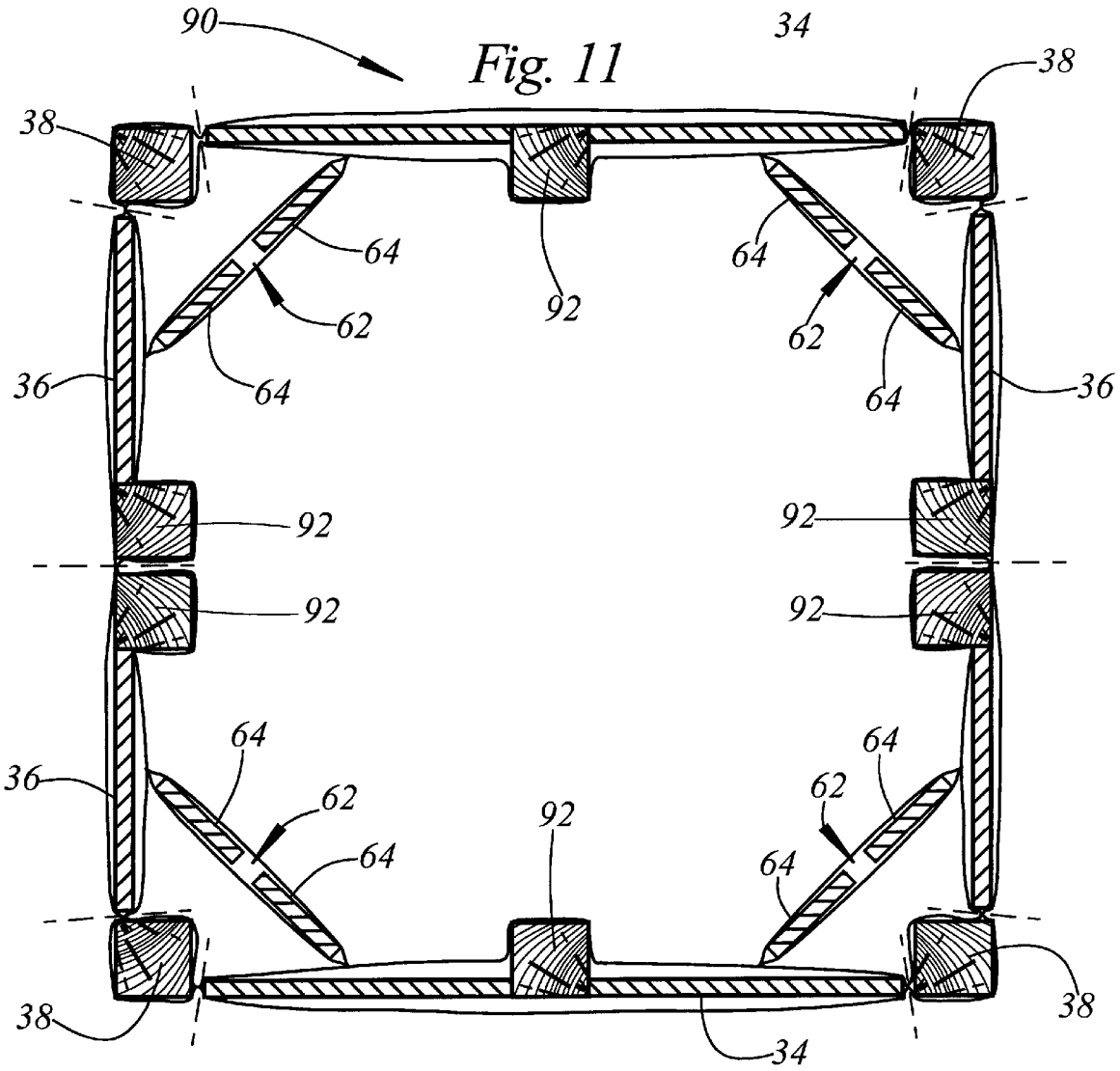
FIG. 11 is a diagrammatic illustration of a third embodiment of the invention.
Figure 12:
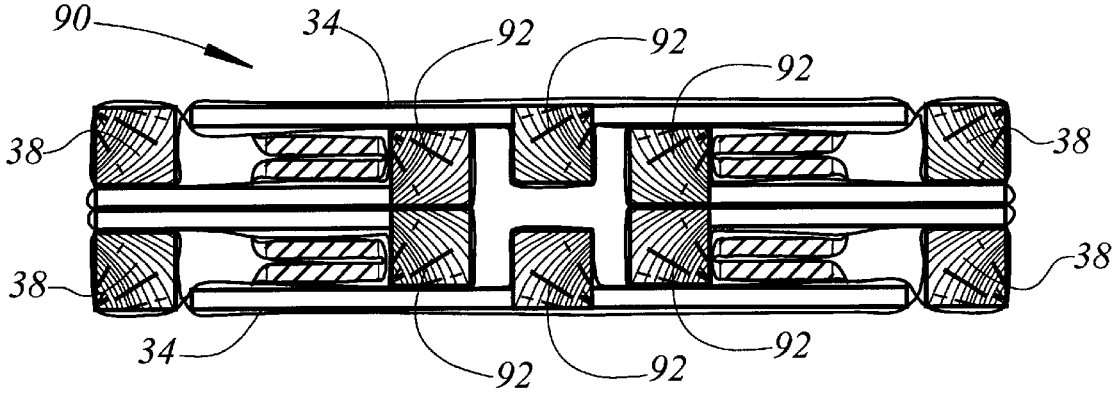
FIG. 12 is a diagrammatic illustration of the foldability of the third embodiment of the invention.

Referring to FIGS. 11 and 12, there is shown a bulk bag 90 comprising a third embodiment of the invention. The bulk bag 90 is virtually identical to the bulk bag 60 illustrated in FIGS. 6, 7, and 8 and described hereinabove in conjunction therewith. The bulk bag 90 differs from the bulk bag 60 in that it is provided with a plurality of additional sleeves similar to the sleeves 32 and in that it is provided with a plurality of additional stiffener rods 92 located in the mid-regions of the double layer side walls comprising the bulk bags. The additional stiffener rods 92 are preferably formed from wood, however, the additional stiffener rods 92 may be formed from other conventional materials depending upon the requirements of particular applications of the invention. The use of the additional stiffener rods 92 is advantageous in that it further increases the stackability of the bulk bag.

The use of two stiffener panels 64 in each of the baffles 62 allows the baffles 62 to be folded inwardly. The use of two stiffener panels 36 and the use of duplicate additional stiffener rods 92 in conjunction with each of the double layer side walls 26 and 30 allows the side walls 26 and 30 to be folded inwardly. In this manner, the bulk bag 90 may be folded into the configuration illustrated in FIG. 12 to facilitate storage and transportation of the bulk bag prior to its ultimate utilization.

Figure 13:
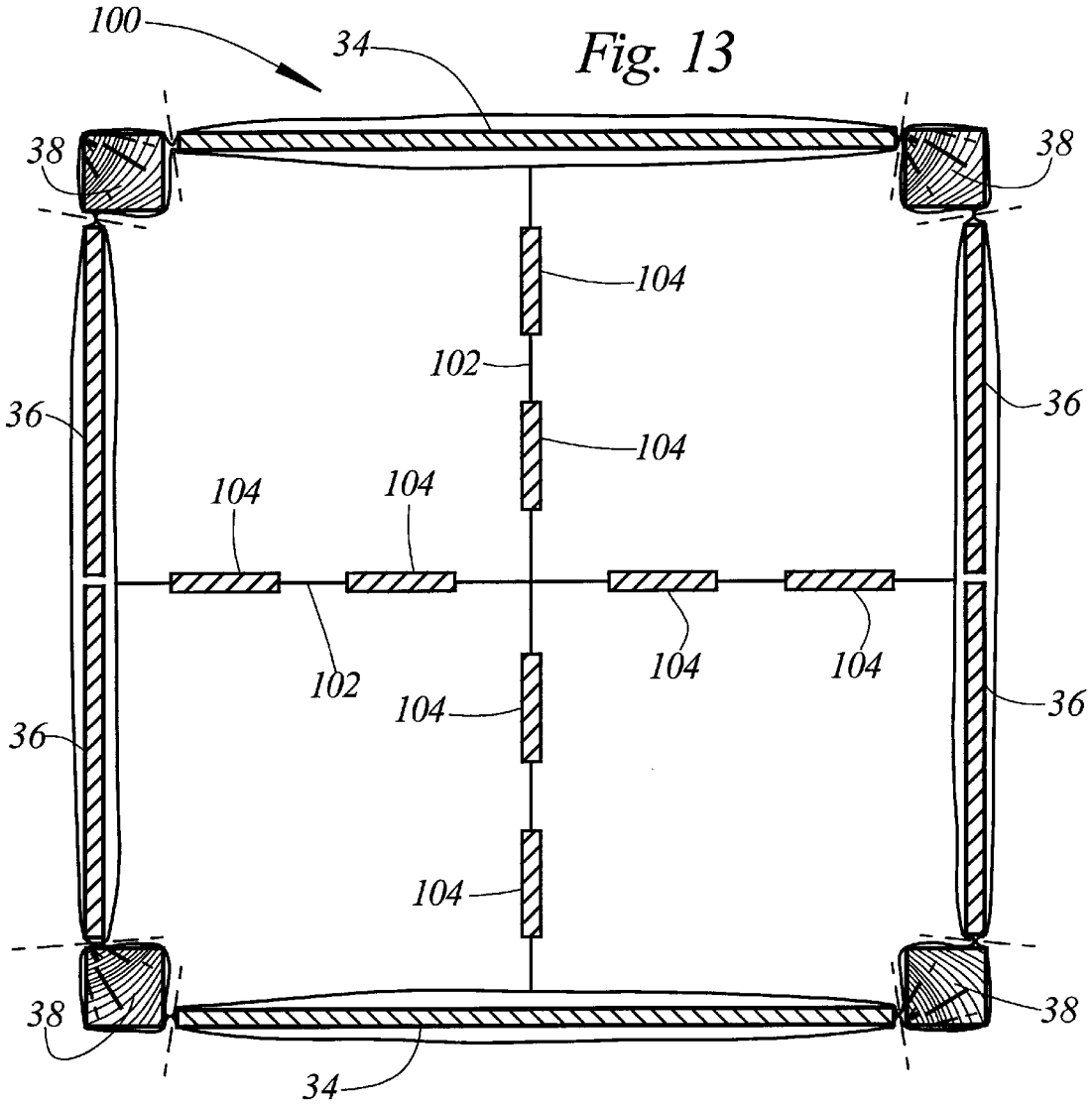
FIG. 13 is a diagrammatic illustration of a fourth embodiment of the invention.
Figure 14:
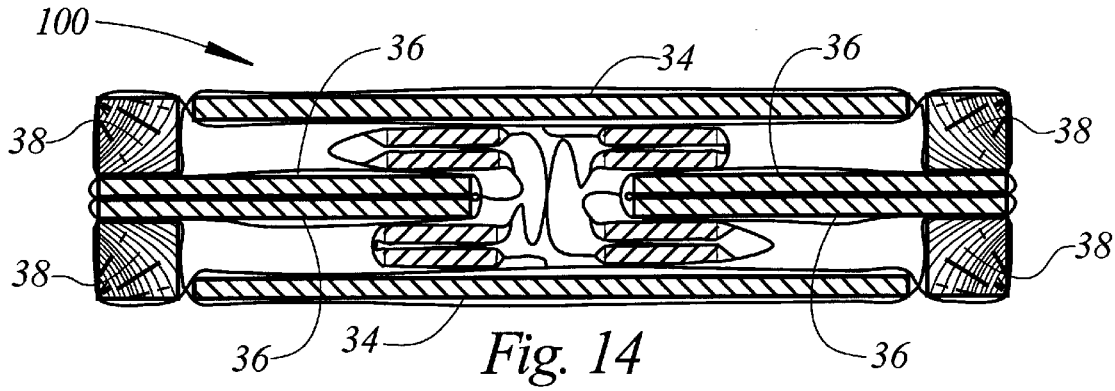
FIG. 14 is a diagrammatic illustration of the foldability of the fourth embodiment of the invention.

Referring to FIGS. 13, 14, and 15, there is shown a bulk bag 100 comprising a fourth embodiment of the invention. The bulk bag 100 is virtually identical to the bulk bag 20 illustrated in FIGS. 1, 2, and 3 and described hereinabove in conjunction therewith. The bulk bag 100 differs from the bulk bag 20 in that it is provided with perpendicular double layer dividers 102 which extend across the interior of the bulk bag from the mid-points of the side walls thereof. The dividers 102 are preferably fabricated from woven polypropylene fabric and are secured to the side walls of the bulk bag 100 by sewing in the conventional manner. The dividers 102 are each provided with four stiffener panels 104 which are preferably formed from oil impregnated five-ply plywood. Other conventional materials may be utilized in the fabrication of the dividers 102 and the stiffener panels 104 depending upon the requirements of particular applications of the invention.

The dividers 102 separate the interior of the bulk bag 100 into four quadrants. This is advantageous in those applications of the invention in which different materials are received, stored, transported, and discharged from the same bulk bag. The use of the bulk bag 100 is also advantageous in those applications of the invention in which it is desirable to discharge a portion of the contents of the bulk bag without disturbing the remaining contents thereof.

The use of two stiffener panels 36 in the side walls 26 and 30 of the bulk bag 100 facilitates the folding of the side walls 26 and 30 inwardly. The use of multiple stiffener panels 104 in each double layer divider 102 of the bulk bag 100 facilitates the folding of the dividers 102. In this manner, the bulk bag 100 can be folded into the configuration illustrated in FIG. 14 which facilitates storage and transportation of the bulk bag 100 prior to its ultimate utilization.

Although preferred embodiments of the invention have been illustrated in the accompanying Drawings and described in the foregoing Detailed Description, it will be understood that the invention is not limited to the embodiments disclosed but is capable of numerous rearrangements, modifications, and substitutions of parts and elements without departing from the spirit of the invention.

I claim:

1. A bulk bag for receiving, storing, transporting, and discharging liquids comprising:

four double layer side walls connected end to end to define four corners;

four sleeves each located at one of the corners between adjacent double layer side walls;

at least four stiffener panels each positioned between the layers comprising one of the side walls; and at least four stiffener rods each received in one of the sleeves;

four double layer baffles each extending diagonally across one of the interior corners of the bulk bag; and at least four stiffeners each received between the double layers comprising one of the baffles.

2. The bulk bag according to claim 1 wherein each of the baffles receives two stiffener panels so that the baffles are foldable inwardly to facilitate folding of the bulk bag for storage and transportation prior to its ultimate utilization.

3. A bulk bag for receiving, storing, transporting, and discharging liquids comprising:

four double layer side walls connected end to end to define four corners;

four sleeves each located at one of the corners between adjacent double layer side walls;

at least four stiffener panels each positioned between the layers comprising one of the side walls; and at least four stiffener rods each received in one of the sleeves;

opposed side walls each receiving two stiffener panels adjacent the ends thereof and a single stiffener in the mid-region thereof to prevent folding of the bulk bag and thereby facilitating emptying of the bulk bag from the top thereof.

4. A bulk bag for receiving, storing, transporting, and discharging liquids comprising:

four double layer side walls connected end to end to define four corners;

four sleeves each located at one of the corners between adjacent double layer side walls;

at least four stiffener panels each positioned between the layers comprising one of the side walls; and at least four stiffener rods each received in one of the sleeves; and double layer dividers extending across the interior of the bulk bag from the midpoints of opposed side walls for dividing the bulk bag into four quadrants, each of the dividers receiving at least one stiffener panel therein.

5. The bulk bag according to claim 4 wherein each of the dividers receives multiple stiffener panels to facilitate folding of the bulk bag for storage and transportation prior to its ultimate utilization.

6. A bulk bag for receiving, storing, transporting, and discharging liquids comprising:

four double layer side walls connected end to end to define four corners;

four substantially square sleeves each located at one of the corners;

at least four stiffener panels each positioned between the layers comprising one of the side walls; and at least four substantially square stiffener rods each received in one of the sleeves.

* * * * *